US008043014B2

(12) United States Patent
Tamaki et al.

(10) Patent No.: US 8,043,014 B2
(45) Date of Patent: Oct. 25, 2011

(54) PRINTER WITH CANTILEVERED FIRST GUIDE ARM AND SECOND GUIDE ARM MOVEABLE ALONG THE FIRST GUIDE ARM

(75) Inventors: Kazutaka Tamaki, Tomi (JP); Naoto Musha, Tomi (JP)

(73) Assignee: Mimaki Engineering Co., Ltd., Nagano (JP)

( * ) Notice: Subject to any disclaimer, the term of this patent is extended or adjusted under 35 U.S.C. 154(b) by 486 days.

(21) Appl. No.: 11/695,443

(22) Filed: Apr. 2, 2007

(65) Prior Publication Data

US 2007/0231040 A1 Oct. 4, 2007

(30) Foreign Application Priority Data

Apr. 3, 2006 (JP) ..... 2006-101924

(51) Int. Cl.
*B41J 3/28* (2006.01)
*B41J 2/01* (2006.01)
*B41J 25/304* (2006.01)
*B41J 25/308* (2006.01)

(52) U.S. Cl. ..... 400/29; 400/352; 400/354; 400/23; 347/37

(58) Field of Classification Search ..... 400/23, 400/29, 30, 48, 354, 352, 18; 347/37
See application file for complete search history.

(56) References Cited

U.S. PATENT DOCUMENTS

| | | | | |
|---|---|---|---|---|
| 6,341,831 | B1 * | 1/2002 | Weber et al. | 347/1 |
| 7,036,131 | B2 * | 4/2006 | Pedersen et al. | 720/619 |
| 7,393,073 | B2 * | 7/2008 | Zach | 347/12 |
| 2006/0181567 | A1 * | 8/2006 | Tezuka | 347/22 |

FOREIGN PATENT DOCUMENTS

| | | | |
|---|---|---|---|
| FR | 2601265 | A1 * | 1/1988 |
| JP | 61032771 | A * | 2/1986 |
| JP | 63233862 | A * | 9/1988 |
| JP | 03096399 | A * | 4/1991 |
| JP | 2002331709 | A * | 11/2002 |
| JP | 2003-191455 | | 7/2003 |
| JP | 2004-148666 | | 5/2004 |
| WO | WO 2004016438 | A1 * | 2/2004 |

* cited by examiner

*Primary Examiner* — Daniel J Colilla
(74) *Attorney, Agent, or Firm* — Ditthavong Mori & Steiner, P.C.

(57) ABSTRACT

A printer includes a supporting device, a cantilevered first guide arm, a second guide arm, and a printer head. The supporting device is configured to support a material to be printed. The cantilevered first guide arm has a longitudinal direction. The second guide arm is connected to the first guide arm to be movable along the longitudinal direction of the first guide. The second guide arm extends along a lateral direction substantially perpendicular to the longitudinal direction. The printer head is configured to print on the material supported by the supporting device and provided on the second guide arm to be movable along the lateral direction.

6 Claims, 2 Drawing Sheets

PRINTER WITH CANTILEVERED FIRST GUIDE ARM AND SECOND GUIDE ARM MOVEABLE ALONG THE FIRST GUIDE ARM

CROSS-REFERENCE TO RELATED APPLICATIONS

The present application claims priority under 35 U.S.C. §119 to Japanese Patent Application No. 2006-101924, filed Apr. 3, 2006, entitled "Printer Apparatus." The contents of this application are incorporated herein by reference in their entirety.

BACKGROUND OF THE INVENTION

1. Field of the Invention

The present invention relates to a printer.

2. Discussion of the Background

Various types of printers that print characters, figures, etc. on a substrate such as a paper are available. Among them, printers adapted to be connected to a computer are used widely for business or household purpose. A conventional, typical printer prints characters, etc. on a substrate such as a paper or sheet material, while feeding the substrate in a predetermined direction and moving a printer head in a direction perpendicular to that of the substrate. A printer of this type is described in Japanese Unexamined Patent Application Publications 2003-191455 and 2004-148666. The contents of these applications are incorprated herein by reference in their entirety.

Such a typical printer handles substrates of a predetermined size and shape. A printer prints a substrate by moving a print head over the substrate and by feeding the substrate in the direction perpendicular to that of the print head. Therefore, it is difficult for a printer to handle substrates of different sizes or shapes. In other words, substrates handled by a printer are limited.

SUMMARY OF THE INVENTION

According to one aspect of the present invention, a printer includes a supporting device, a cantilevered first guide arm, a second guide arm, and a printer head. The supporting device is configured to support a material to be printed. The cantilevered first guide arm has a longitudinal direction. The second guide arm is connected to the first guide arm to be movable along the longitudinal direction of the first guide. The second guide arm extends along a lateral direction substantially perpendicular to the longitudinal direction. The printer head is configured to print on the material supported by the supporting device and is provided on the second guide arm to be movable along the lateral direction.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE EMBODIMENTS

Figure 1:
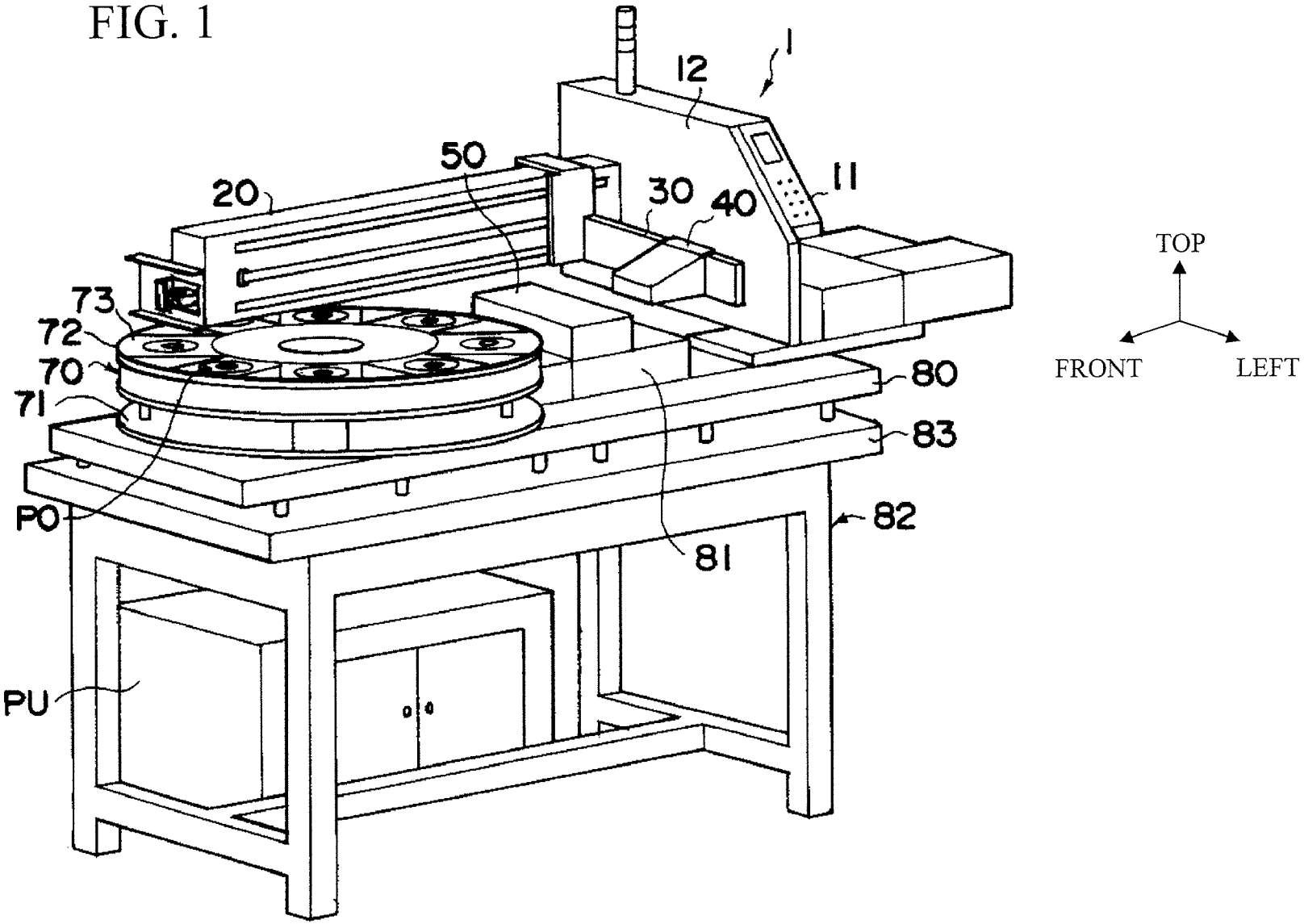
FIG. 1 is a schematic view depicting a printer according to an embodiment of the present invention.

The embodiments will now be described with reference to the accompanying drawings, wherein like reference numerals designate corresponding or identical elements throughout the various drawings.

Referring to FIG. 1, a printer according to one embodiment of the present invention includes a table 82 having a top plate 83, a base plate 80 placed on the top plate 83, and both a print mechanism 1 and a rotatable support apparatus 70 arranged on the base plate 80. In addition, a power supply unit (PU) is provided under the table 82.

Figure 2:
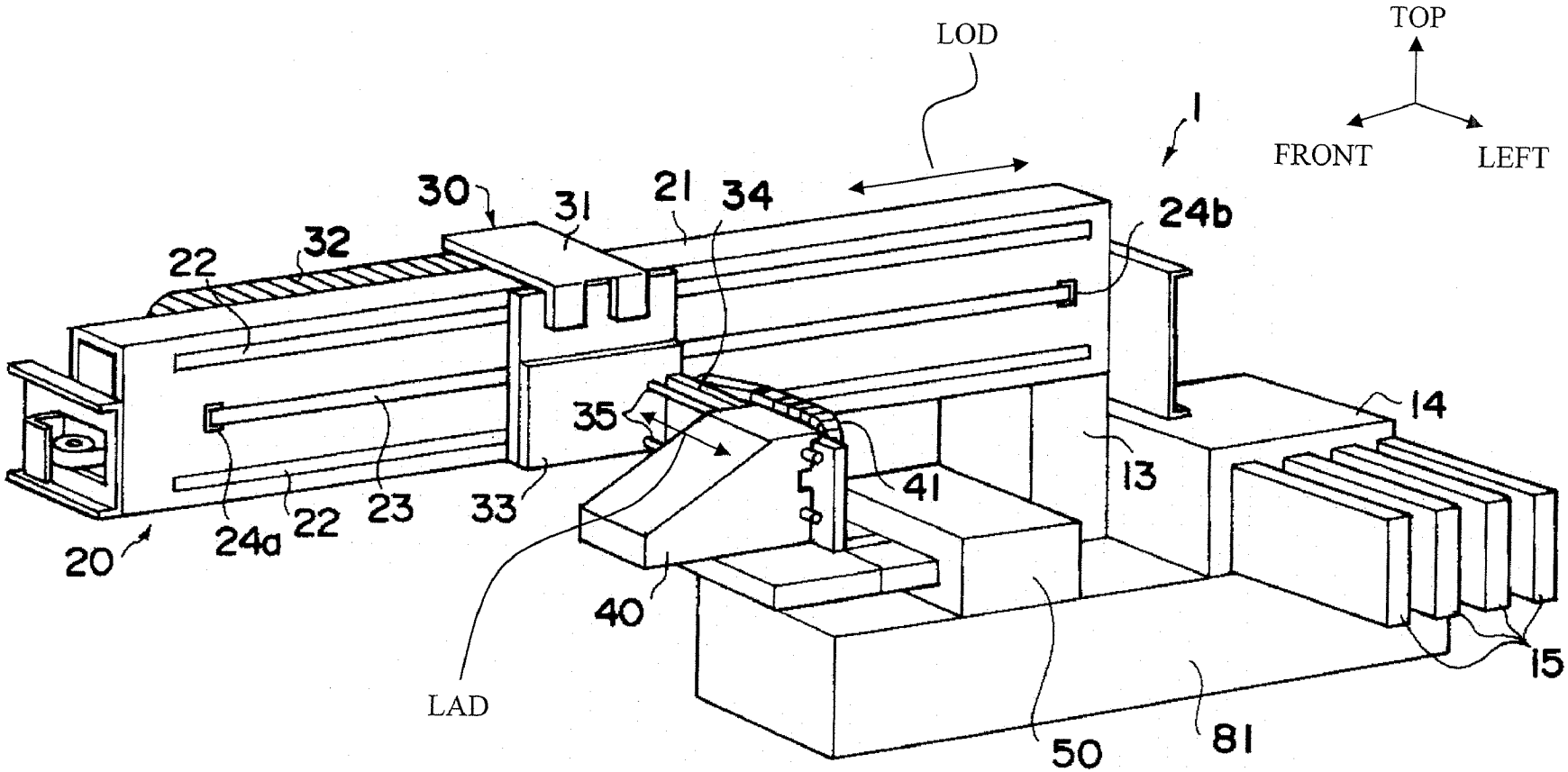
FIG. 2 is a schematic view depicting a print mechanism of the printer according to the embodiment of the present invention.

Note that directions of the following description correspond to those shown in FIGS. 1 and 2.

Referring to FIG. 2, the print mechanism 1 includes a base 81, both a maintenance station 50 and an ink supply device 14 arranged on the base 81, and a pole 13 standing vertically. Moreover, the pole 13 includes a first guide arm (a cantilevered first guide arm) 20 extending in the front direction (longitudinal direction LOD), a second guide arm 30 movable along the first guide arm 20 and extending in the left direction, and a print head 40 movable laterally along the second guide arm 30. The ink supply device 14 is provided with black and other three color ink cartridges 15 in a detachable fashion. The maintenance station 50 sucks and cleans nozzles of the print head 40 when the print head 40 enters the station 50, as will be described later. Note that both an operation unit 11 and a cover 12 that covers the unit 11 except its display and switches are attached to the rear of the ink supply device 14 in FIG. 1, but they are both removed in FIG. 2.

The first guide arm 20 includes a first arm member 21, a pair of guide rails 22 and 22, a driving belt 23. The first arm member 21 has a rectangular cross section, and it is fixed on the pole 13 with extending in the front direction. The guide rails 22 and 22 are formed on the left surface of the first arm member 21 in parallel with each other, and both of them are away from one another by a predetermined distance. The driving belt 23 is provided between the guide rails 22 and 22 in parallel thereto with extending from a front opening 24*a* to a rear opening 24*b*. The driving belt 23 is fed back and forth along the left surface of the first arm member 21 by a driving mechanism in the first arm member 21.

The second guide arm 30 includes a first moving member 31, a second moving member 33, a second arm member 34 and a pair of guide rods 35 and 35. The first moving member 31 is movable back and forth along the guide rails 22 and 22 of the first arm member 21. The second moving member 33 is attached to the first moving member 31 in such a way the member 33 is movable vertically. The second arm member 34 is fixed to the second moving member 33 with extending in the left direction (lateral direction LAD). The guide rods 35 and 35 are formed on the second moving member 33 with extending in the left direction, and both rods are in parallel with each other and away from one another by a predetermined distance. Furthermore, in order to connect the first moving member 31 to the first guide arm 20, a first flexible cable guide 32 such as the cable bear is provided. The first flexible cable guide 32 contains wires for supplying power or a signal, and a flexible tube for supplying ink. In other words, power, a control signal or ink is supplied to the second guide arm 30 through the cable guide 32.

The print head 40 is movably secured to the guide rods 35 and 35. This head is movable along the guide rods 35 and 35, and a driving mechanism (not shown) in the second guide arm 30 allows the print head 40 to travel from side to side along the second guide arm 30. On the lower surface of the print head 40, multiple inkjet nozzles (not shown) are arranged with facing their openings downward. These inkjet nozzles discharge ink, whereby the printer prints desired characters, figures, etc. on a substrate. In addition, a second flexible cable guide 41 connects the print head 40 to the second guide arm 30. The second flexible cable guide 41 contains wires for supplying power or a signal and a flexible tube for supplying ink. In other words, power, a control signal or ink is supplied to the print head 40 through the cable guide 41.

The rotatable support apparatus 70 includes a disc-shaped rotatable support member 71 on the base plate 80, a disc-shaped rotatable member 72 rotatably fixed to the rotatable support member 71, and a mechanism (not shown) for rotatably drive the rotatable member 72. On the rotatable member 72, multiple set portions 73 are arranged on the circumference of the rotatable member 72. In one embodiment of the present invention, disc-shaped memory media such as compact disc read only memories (CD-ROMs) or digital video disks (DVDs) are placed and sucked on the rotatable member 72.

Next, a detailed description will be given below, of an operation in which the above-described printer prints CD-ROMs.

Prior to printing, an automatic transport system or an operator sets CD-ROMs on the corresponding set portions 73 of the rotatable support apparatus 70. Then, the rotatable member 72 sucks and secures the CD-ROMs.

An operator activates the print mechanism 1 through the switches of the operation unit 11. The second guide arm 30 moves back and forth along the first guide arm 20, as well as the print head 40 moves from side to side along the second guide arm 30. Consequently, the print head 40 is positioned above the maintenance station 50.

A maintenance stage (not shown) of the maintenance station 50 moves, and a maintenance cap (not shown) of the maintenance stage comes in contact with the inkjet nozzles. The inkjet nozzles are filled up with ink. The cleaning mechanism of the maintenance stage cleans up the tips of the inkjet nozzles. As a result, the nozzles are ready to print.

Simultaneously with the above steps, the rotatable member 72 on the rotatable support apparatus 70 rotates, so that one of the CD-ROMs on the set portions 73 is moved to a print position. Following this, the second guide arm 30 re-moves back and forth along the first guide arm 20, and the print head 40 re-travels from side to side along the second guide arm 30. The print head 40 stops above the CD-ROM on a print position, and the inkjet nozzles discharge ink there, whereby desired characters or figures are printed on the CD-ROM.

After the CD-ROM is printed, the rotatable member 72 rotates until the printed CD-ROM reaches an eject position, and an automatic transport system or operator then removes the CD-ROM therefrom. At the same time, another CD-ROM on the set portion 73 is rotatably moved to the print position, and the print head 40 then prints this CD-ROM. By repeating the above steps, multiple CD-ROMs can be printed sequentially and continuously.

In this printer, the second moving member 33 of the second guide arm 30 can be displaced vertically with reference to the first moving member 32. This displacement makes it possible to adjust the vertical position of the print head 40. Accordingly, even if individual discs on the set portions 73 differ in thickness, the printer can accommodate this difference by displacing the print head 40 vertically. In conclusion, this printer has enhanced flexibility.

As described above, the printer according to one embodiment of the present invention has been described. However, the present invention is not limited thereto. Alternatively, a transport system constituted of a belt moving from side to side under the first guide arm 20 may be provided on the base plate. With this system, substrates are carried laterally in a straight line, and they are then moved to the print position in turn. Following this, the printed substrates are moved to the eject position. As a result, many substrates can be printed sequentially, automatically and continuously.

Obviously, numerous modifications and variations of the present invention are possible in light of the above teachings. It is therefore to be understood that within the scope of the appended claims, the invention may be practiced otherwise than as specifically described herein.

What is claimed as new and is desired to be secured by Letters Patent of the United States is:

1. A printer comprising:

a supporting device configured to support a material to be printed and including a base;

a pole fixed to and extending vertically from the base;

a cantilevered first guide arm having a first end fixed to the pole, the first guide arm extending horizontally in a longitudinal direction from the first end to a second end thereof, the first guide arm having a pair of guide rails that extend parallel to one another in the longitudinal direction along a side of the first guide arm such that one of the guide rails is located vertically above the other guide rail;

a first movable member connected to the pair of guide rails of the first guide arm to be movable along the longitudinal direction of the first guide arm;

a second movable member connected to the first movable member to be movable in a vertical direction substantially perpendicular to the material;

a cantilevered arm member having an end connected to the second movable member, the arm member having a pair of guide rods extending in parallel to one another and horizontally along a lateral direction substantially perpendicular to the longitudinal direction such that one of the guide rods is located vertically above the other guide rod;

a printer head configured to print on the material supported by the supporting device and provided on the pair of guide rods of the arm member to be movable along the lateral direction;

a maintenance station mounted on the base and configured to clean nozzles of the printer head during a cleaning operation; and an ink supply device mounted on the base and configured to supply ink to the print head during a printing operation.

2. The printer according to claim 1, wherein the supporting device is provided under the cantilevered first guide arm and the arm member.

3. The printer according to claim 1, wherein the supporting device comprises:

a plurality of mounting portions each of which the material is to be placed on; and a moving device configured to move each of the plurality of mounting portions to a position where the material is to be printed.

4. The printer according to claim 3, wherein the plurality of mounting portions are arranged along a circle, and wherein the moving device is configured to rotate the plurality of mounting portions along the circle.

5. The printer according to claim 1, further comprising a driving belt extending along the side of the first guide arm, wherein the driving belt is connected to the first movable member.

6. The printer according to claim 5, wherein the driving belt extends parallel to and in between the pair of guide rails.

* * * * *